US012372077B2

(12) United States Patent
Schrank et al.

(10) Patent No.: US 12,372,077 B2
(45) Date of Patent: Jul. 29, 2025

(54) RECIPROCATING PISTON PUMP FOR CONVEYING A MEDIUM

(71) Applicant: Hauhinco Maschinenfabrik G. Hausherr, Jochums GmbH & Co. KG, Sprockhövel (DE)

(72) Inventors: Katharina Schrank, Aachen (DE); Florian Schoemaker, Pfaffenhofen a.d. Roth (DE); Dirk Schulze Schencking, Wuppertal (DE)

(73) Assignee: Hauhinco Maschinenfabrik G. Hausherr, Jochums GmbH & Co. KG, Sprockhövel (DE)

( * ) Notice: Subject to any disclaimer, the term of this patent is extended or adjusted under 35 U.S.C. 154(b) by 0 days.

(21) Appl. No.: 18/068,141

(22) PCT Filed: Jun. 10, 2021

(86) PCT No.: PCT/EP2021/065610
§ 371 (c)(1),
(2) Date: Dec. 19, 2022

(87) PCT Pub. No.: WO2021/254869
PCT Pub. Date: Dec. 23, 2021

(65) Prior Publication Data

US 2024/0141890 A1 May 2, 2024

(30) Foreign Application Priority Data

Jun. 19, 2020 (DE) ..... 102020116294.4

(51) Int. Cl.
*F04B 3/00* (2006.01)
*F04B 5/02* (2006.01)
(Continued)

(52) U.S. Cl.
CPC ..... *F04B 3/003* (2013.01); *F04B 5/02* (2013.01); *F04B 13/02* (2013.01); *F04B 19/22* (2013.01); *F04B 49/125* (2013.01); *F04B 53/18* (2013.01)

(58) Field of Classification Search
CPC .. F04B 5/02; F04B 13/02; F04B 19/22; F04B 53/18; F04B 5/00; F04B 3/003; F04B 3/00
See application file for complete search history.

(56) References Cited

U.S. PATENT DOCUMENTS

2006/0060611 A1* 3/2006 Wichmann ..... F04B 13/02 222/383.1
2014/0298989 A1* 10/2014 Buchenau ..... B60T 8/4031 92/69 R
2023/0071844 A1* 3/2023 Benistand-Hector ..... F04B 23/021

FOREIGN PATENT DOCUMENTS

DE 3545631 A1 8/1986
DE 102016210728 * 12/2017 ..... F02M 21/0218
(Continued)

OTHER PUBLICATIONS

English translation of DE102016210728, generated from Espasnet website on Jul. 3, 2024. (Year: 2024).*
(Continued)

*Primary Examiner* — Bryan M Lettman
(74) *Attorney, Agent, or Firm* — Calderon Safran & Wright P.C.; Andrew Wright

(57) ABSTRACT

A reciprocating piston pump includes a pump module, a drive, and an auxiliary piston. The pump module includes a cylinder head, a cylinder and a piston that form a conveying chamber. The piston converts a drive movement of the drive into conveying and suctioning stroke movements. The auxiliary piston is between the drive and the piston. The
(Continued)

cylinder, the piston and the auxiliary piston convert the drive movement into auxiliary conveying and suctioning stroke movements, and convert the auxiliary conveying stroke movement into the conveying stroke movement of the piston via a lubricating medium in a lubricating chamber formed by the cylinder, the piston and the auxiliary piston head. A head surface of the auxiliary piston is smaller than a head surface of the piston, so that, during the auxiliary conveying stroke movement, a pressure in the lubricating chamber is greater than a pressure in the conveying chamber.

16 Claims, 5 Drawing Sheets

(51) Int. Cl.

| | |
|---|---|
| ***F04B 13/02*** | (2006.01) |
| ***F04B 19/22*** | (2006.01) |
| ***F04B 49/12*** | (2006.01) |
| ***F04B 53/18*** | (2006.01) |

(56) References Cited

FOREIGN PATENT DOCUMENTS

| | | | |
|---|---|---|---|
| DE | 102016210728 | A1 | 12/2017 |
| DE | 102016220840 | A1 | 4/2018 |
| WO | 2020149472 | A1 | 7/2020 |

OTHER PUBLICATIONS

International Search Report and Written Opinion of the International Searching Authority; Application No. PCT/EP2021/065610; Completed: Sep. 3, 2021; Mailing Date: Sep. 13, 2021; 9 Pages.

* cited by examiner

RECIPROCATING PISTON PUMP FOR CONVEYING A MEDIUM

TECHNICAL FIELD

The invention relates to a reciprocating piston pump for conveying a medium. The reciprocating piston pump has, on the one hand, at least one pump module and, on the other hand, a drive. The drive is designed for driving the at least one pump module so that the at least one pump module conveys a medium during operation.

BACKGROUND

The reciprocating piston pump is used to supply devices with power, wherein the power is transmitted via a medium that is pressurized by the reciprocating piston pump for this purpose while being conveyed. During operation, the reciprocating piston pump generates a pressure in the medium of more than 160 bar. The reciprocating piston pump and devices to be supplied are connected, for example, to a hydraulic circuit for transmitting the power.

The at least one pump module has a cylinder head, a cylinder, and a reciprocating piston, wherein the reciprocating piston has a reciprocating piston head with a reciprocating piston head surface. The cylinder head, the cylinder, and the reciprocating piston head form a conveying chamber. In other words, the cylinder head, the cylinder, and the reciprocating piston head enclose the conveying chamber.

The reciprocating piston is designed for converting a drive movement of the drive into a conveying stroke movement and a suctioning stroke movement of the reciprocating piston in the cylinder along a longitudinal axis. Accordingly, the conveying chamber is not constant: the conveying chamber is made smaller as the reciprocating piston approaches the cylinder head during the conveying stroke movement. At the same time, a pressure in a medium located in the conveying chamber increases. The conveying chamber is made larger when the reciprocating piston moves away from the cylinder head during the suctioning stroke movement. At the same time, a pressure in a medium located in the conveying chamber decreases.

The cylinder head, the cylinder, and the reciprocating piston are designed for converting the conveying stroke movement into the conveying of a medium out of the conveying chamber by making the conveying chamber smaller. Usually, they are also designed for converting the suctioning stroke movement into a suctioning of a medium into the conveying chamber by making the conveying chamber larger.

The design of the cylinder head includes, for example, a cylinder head controller which ensures an inflow of a medium into the conveying chamber during the suctioning stroke movement and an outflow of a medium from the conveying chamber during the conveying stroke movement. For this, the cylinder head controller has, for example, an inflow valve and an outflow valve. The design of the cylinder and the reciprocating piston includes, for example, sealing them tightly together so that a pressure in a medium in the conveying chamber increases during the conveying stroke movement and decreases during the suctioning stroke movement.

The reciprocating piston pump is specified for conveying media that have a lower viscosity than lubricating media. Such media are, for example, HFA and HFC media, water-glycol mixtures and also water. Accordingly, it is also intended for conveying media that are corrosive. It is also designed for conveying media containing particles, i.e. abrasive media.

Furthermore, the reciprocating pump is intended for generating pressures during the conveying stroke movement at which media are no longer suitable for lubricating contact surfaces between cylinder and reciprocating piston and bearings in the drive. Such pressures are, for example, in excess of 150 bar.

Due to the media and the pressures, these contact surfaces and bearings must be lubricated with a lubricant that is different from the media, and a media separation must be implemented between the media on the one hand and the lubricant on the other. The media separation must ensure that no leakage of the medium into the lubricating medium occurs. Leakage of the medium into the lubricating medium leads to deterioration of lubricating properties of the lubricating medium, whereby lubrication of the contact surfaces and bearings is no longer ensured and the contact surfaces and bearings are damaged. Conversely, a slight leakage of the lubricating medium into the medium is tolerable.

Various implementations of media separation are known from the prior art.

Media separation is implemented by means of a gland seal between the reciprocating piston and the cylinder. To ensure that the gland seal seals is the cylinder and the reciprocating piston sufficiently tightly together, the gland seal must be saturated with the medium. However, ensuring that it is saturated with the medium also inevitably leads to leakage of the medium into the lubricant, so that the lubricant must be replaced at intervals in accordance with the concentration of the medium in the lubricant. Another disadvantage is that a sealing surface of the gland seal is large and requires the drive to apply correspondingly high frictional forces. Furthermore, the sealing surface cannot be controlled.

In another implementation, an elastomer seal is used. To reduce wear on the elastomer seal, it must be cooled. The medium is used for this purpose, but this requires a small amount of leakage past the elastomer seal. Thus, even when an elastomer seal is used, the medium enters the lubricating medium. Further, a frequency of the conveying stroke and the suctioning stroke is limited to a maximum frequency due to viscoelastic properties of the elastomer seal.

In another implementation, the reciprocating piston and the conveying chamber are separated by a diaphragm. Here, the conveying chamber is formed by the cylinder head, the cylinder and the diaphragm. This implementation ensures complete media separation, which is why no leakage occurs. The diaphragm follows the conveying stroke movement and suctioning stroke movement of the reciprocating piston. However, the diaphragm rubs against the reciprocating piston and cylinder, causing it to wear and eventually require replacement.

SUMMARY

The object of the present invention is to provide a reciprocating piston pump with a media separation which at least reduces the disadvantages shown from the prior art.

The object is achieved by a reciprocating piston pump with the disclosed features.

The reciprocating piston pump has an auxiliary reciprocating piston. The auxiliary reciprocating piston is arranged between the drive and the reciprocating piston and has an auxiliary reciprocating piston head with an auxiliary reciprocating piston head surface.

The cylinder, the reciprocating piston and the auxiliary reciprocating piston head form a lubrication chamber for a lubricating medium for lubricating contact surfaces between, on the one hand, the cylinder and, on the other hand, the reciprocating piston and the auxiliary reciprocating piston. In other words, the cylinder, reciprocating piston, and auxiliary reciprocating piston head enclose the lubrication chamber.

The cylinder, the reciprocating piston and the auxiliary reciprocating piston are designed for converting the drive movement into an auxiliary conveying stroke movement and into an auxiliary suctioning stroke movement of the auxiliary reciprocating piston in the cylinder along the longitudinal axis, and for converting the auxiliary conveying stroke movement of the auxiliary reciprocating piston into the conveying stroke movement of the reciprocating piston via a lubricating medium in the lubricating volume.

Because the lubrication chamber is formed not only by the cylinder but also by the reciprocating piston and the auxiliary reciprocating piston head, a lubricating medium is in direct contact with the cylinder. Due to the conveying and suctioning stroke movement of the reciprocating piston and due to the auxiliary conveying and auxiliary suctioning stroke movement of the auxiliary piston, both the reciprocating piston and the auxiliary reciprocating piston move over sections of the cylinder which were previously in direct contact with a lubricating medium, whereby the contact surfaces between, on the one hand, the cylinder and the reciprocating piston and, on the other hand, the cylinder and the auxiliary reciprocating piston are lubricated with the lubricating medium.

The auxiliary reciprocating piston head surface is smaller than the reciprocating piston head surface, so that a pressure of a lubricating medium in the lubricating chamber is larger than a pressure of a medium in the conveying chamber during the auxiliary conveying stroke movement. In other words, the pressure in the lubricating medium is larger than the pressure in the medium because the auxiliary reciprocating piston head surface is smaller than the reciprocating piston head surface.

Because the pressure in the lubrication chamber is greater than the pressure in the medium in the conveying chamber, leakage occurs only from the lubrication chamber to the conveying chamber and in the direction of the drive. While leakage in the direction of the drive is unproblematic, leakage into the conveying chamber is tolerable. In any case, no medium penetrates into the lubricant, so that the lubricating properties of the lubricant do not deteriorate.

In comparison with the first two described implementations of the medium separation, leakage of the medium into the lubricating medium no longer occurs. Also, compared to the first implementation, the friction power is reduced and compared to the second implementation, the maximum frequency is higher. Compared to the third implementation of the media separation, the wear is reduced and thus the maintenance intervals are extended.

In one design of the reciprocating piston pump, it is provided that the cylinder has a cylinder inner lateral surface concentric to the longitudinal axis with a cylinder radius, that the reciprocating piston has a reciprocating piston outer lateral surface concentric to the longitudinal axis with a reciprocating piston radius, and that the auxiliary reciprocating piston has an auxiliary reciprocating piston outer lateral surface concentric to the longitudinal axis with an auxiliary reciprocating piston radius. It is further provided that both the reciprocating piston radius and the auxiliary reciprocating piston radius match the cylinder radius.

For example, the cylinder radius has a first value over a first distance along the longitudinal axis and a second value over a second distance along the longitudinal axis that is less than the first value. Then, the reciprocating piston radius has a value matching the first value and the auxiliary reciprocating piston radius has a value matching the second value. In this case, the first distance extends over the reciprocating piston's conveying and suctioning stroke movement and the second distance extends over the auxiliary conveying and suctioning stroke movement of the auxiliary reciprocating piston.

Preferably, however, the reciprocating piston radius and the auxiliary reciprocating piston radius are the same. Then the cylinder radius has the same value over the first and second distances, and the reciprocating piston radius and the auxiliary reciprocating piston radius have a value matching the value.

If the auxiliary conveying stroke movement of the auxiliary stroke piston is converted into the conveying stroke movement of the reciprocating piston via a lubricating chamber in the conveying chamber, then a pressure in the lubricating chamber is higher than a pressure in the medium in the conveying chamber. This is achieved by the auxiliary reciprocating piston head surface being smaller than the reciprocating piston head surface. A reduction of the auxiliary reciprocating piston head surface relative to the reciprocating piston head surface is implemented in a further design in that the reciprocating piston has a relief reciprocating piston and the auxiliary reciprocating piston in the auxiliary reciprocating piston head has a relief cylinder matching the relief reciprocating piston, and in that the relief cylinder has a relief chamber and/or is connected to a relief chamber. Preferably, the relief reciprocating piston is a shaft.

Since a very small leakage between, on the one hand, the cylinder and, on is the other hand, the reciprocating piston and the auxiliary reciprocating piston cannot be avoided, the lubrication chamber decreases, and therefore a piston distance between the reciprocating piston and the auxiliary reciprocating piston becomes smaller and the auxiliary conveying stroke movement is larger than the conveying stroke movement. The reduction in piston spacing causes the relief piston to move into the relief cylinder. This causes a pressure in the relief chamber to increase. For example, the relief chamber is formed by the relief piston and the relief cylinder. This increase in pressure counteracts the reduction of the auxiliary piston head surface relative to the piston head surface. Therefore, it is advantageous to select the relief chamber as large as possible.

Preferably, the relief chamber is ambient so that there is virtually no increase in pressure in the relief chamber. For this purpose, the auxiliary piston has a relief line which connects the relief cylinder to the surroundings.

In a further development of the above design, the relief reciprocating piston and the relief cylinder are provided to limit a piston spacing between the reciprocating piston and the auxiliary reciprocating piston along the longitudinal axis to a maximum piston spacing. The effect of limiting the piston spacing is that the lubrication chamber is also limited to a maximum lubrication chamber. Without limiting the piston spacing, there is a possibility that the reciprocating piston could strike the cylinder head during the conveying stroke movement and damage the reciprocating pump.

In another design, the reciprocating pump includes a bearing and the bearing is disposed between the drive piston and the auxiliary reciprocating piston. Further, the bearing is designed for converting the drive movement of the drive into the auxiliary conveying stroke movement and into the auxiliary suctioning stroke movement of the auxiliary reciprocating piston.

In a further development of the above design, it is provided that the drive is has a drive shaft. It is further provided that the drive shaft has a drive eccentric with an eccentric sliding surface and the auxiliary reciprocating piston has an auxiliary reciprocating piston sliding surface. Here, the eccentric sliding surface and the auxiliary reciprocating piston sliding surface form the bearing. Further, the drive shaft and the auxiliary reciprocating piston are designed for converting the drive movement of the drive shaft in the form of rotation via the bearing into the auxiliary conveying stroke movement and the auxiliary suctioning stroke movement. The drive shaft without drive eccentric is designed usually as a crankshaft with a crank pin, whereby the crank pin is arranged rotatably in the drive eccentric. Rotation of the drive eccentric is prevented by an eccentric shape of the eccentric sliding surface in conjunction with the overlying auxiliary reciprocating piston sliding surface. An alternative is a drive shaft with an eccentric journal, wherein the eccentric journal is rotatably arranged in the drive eccentric.

The eccentric sliding surface and the auxiliary reciprocating piston sliding surface have a common contact surface through which the rotation of the drive shaft is converted into auxiliary conveying and auxiliary suctioning stroke movement. In this sense, the eccentric sliding surface and the auxiliary reciprocating piston sliding surface form the bearing. The common contact surface must be lubricated with a lubricant to reduce wear on the eccentric and auxiliary reciprocating piston sliding surfaces. The bearing is designed for a lubricant that is also suitable for the contact surfaces between, on the one hand, the cylinder and, on the other hand, the reciprocating piston and the auxiliary reciprocating piston.

If the reciprocating pump comprises the previously described bearing, then a sufficient supply of a lubricant to the bearing is to be ensured. Therefore, in a further design, it is provided that the auxiliary reciprocating piston comprises an auxiliary reciprocating piston lubrication line, that the auxiliary reciprocating piston lubrication line connects the lubrication chamber and the auxiliary reciprocating piston sliding surface for supplying the bearing with a lubricating medium. Accordingly, the bearing is lubricated with the lubricating medium with which the contact surfaces between, on the one hand, the cylinder and, on the other hand, the reciprocating piston and the auxiliary reciprocating piston are also lubricated. In this case, a lubricating medium is supplied to the bearing at a pressure that is established in the conveying chamber during the conveying stroke movement. Preferably, the auxiliary piston lubrication medium line is a channel in the auxiliary reciprocating piston. Then there is no separate lubrication medium line.

In a further development of the above design, it is provided that the auxiliary reciprocating piston lubrication line comprises at least one check valve. The check valve reduces a run-off of a lubricating medium located in the bearing. The run-off would occur without the check valve, for example, during the suctioning stroke movement.

In another design, the piston pump has a longitudinal slide valve for controlling the supply of a lubrication medium into the lubrication chamber. In this case, the longitudinal slide valve has at least one cylinder opening in the cylinder for feeding a lubrication medium into the lubrication chamber. Preferably, the at least one cylinder opening is a groove, pocket and/or bore. The function of a valve inherently results from either the reciprocating piston conveying and suctioning stroke movement or the auxiliary reciprocating piston conveying and auxiliary suctioning stroke movement past the at least one cylinder opening in the cylinder.

In a particularly preferred further development of the above design, the auxiliary reciprocating piston lubrication line described above is additionally implemented. In this further development, not only are the contact surfaces between, on the one hand, the cylinder and, on the other hand, the reciprocating piston and the auxiliary reciprocating piston, but the bearing is also lubricated with a lubricating medium which can be supplied via the longitudinal slide valve.

In a further development of the above design, it is provided that the at least one cylinder opening releases a supply of a lubrication medium to the lubrication chamber when the reciprocating piston is in the region of a reversal point from the suctioning stroke movement to the conveying stroke movement. In the region of the reversal point, a pressure in the lubrication chamber is the lowest, so the supply of a lubrication medium is the most effective.

If the reciprocating piston pump has the previously described bearing, then a sufficient supply of a lubricant to the bearing is to be ensured.

Alternatively, or in addition to the previously described design having the auxiliary reciprocating piston lubrication line, in the following design, the drive shaft includes a drive lubrication line. Accordingly, the drive lubrication line extends through both the drive shaft itself and the drive eccentric of the drive shaft. Further, the drive shaft has a rotary slide valve for controlling the supply of a lubricating medium into the bearing. In this regard, the rotary slide valve has a drive shaft recess in the drive shaft over an angular range of rotation of the drive shaft so that a supply of a lubricating medium to the bearing occurs only over the angular range.

Preferably, the drive lubrication line is a channel in the drive shaft and in the drive eccentric. Then there is no separate lubrication medium line. The rotary valve is usually formed by the drive shaft recess and the drive lubrication line in the eccentric. The rotary valve also provides lubricant supply to contact surfaces between the drive shaft and the drive eccentric.

In a further development of the above design, it is provided that the drive lubrication line has at least one check valve. The check valve reduces a run-off of a lubricating medium located in the bearing.

In a particularly preferred further development of the above design, the auxiliary reciprocating piston lubrication line described above is additionally implemented. In this further development, not only the bearing but also the contact surfaces between the cylinder on the one hand and the reciprocating piston and the auxiliary reciprocating piston on the other are lubricated with a lubricating medium which can be supplied via the drive lubrication line.

In a further design, the reciprocating pump has a lubrication pump for supplying the at least one pump module and/or the drive with a lubricating medium. In this regard, in designs with the longitudinal slide valve described above, the reciprocating pump is designed for supplying a lubricating medium from the lubricating pump to the longitudinal slide valve, and in designs with the drive lubrication line described above, the reciprocating pump is designed for supplying a lubricating medium from the lubricating pump to the drive lubrication line.

BRIEF DESCRIPTION OF THE DRAWINGS

In detail, a plurality of possibilities are provided for designing and further developing the reciprocating piston pump. For this, reference is made to the following description of embodiments in conjunction with the drawings.

DETAILED DESCRIPTION

Figure 1:
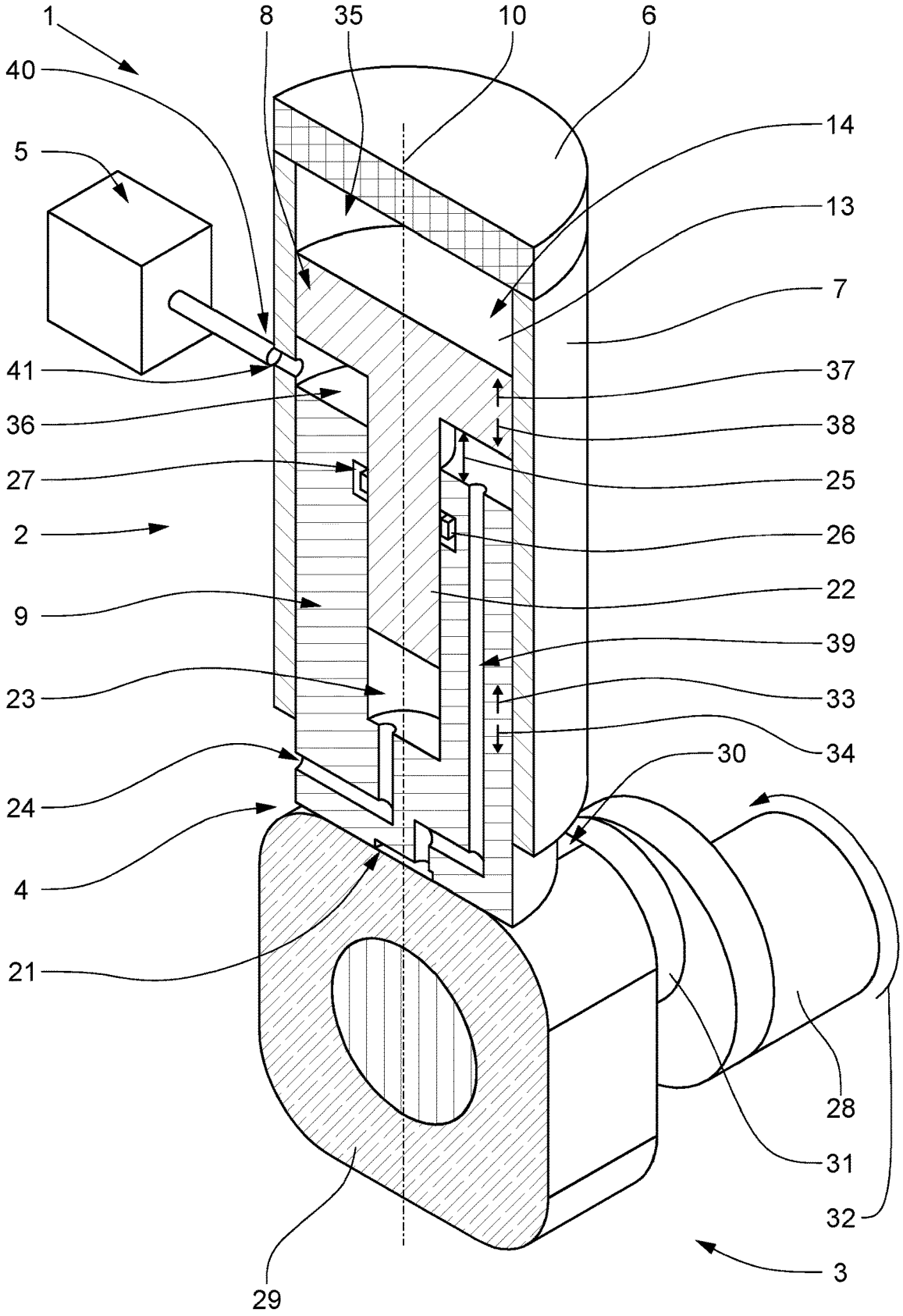
FIG. 1 illustrates an abstracted perspective sectional view of a first embodiment of a reciprocating pump.

FIG. 1 shows a first embodiment of a reciprocating pump 1 for pumping a medium. It has a pump module 2, a drive 3, a bearing 4 and a lubrication pump 5.

Figure 2:
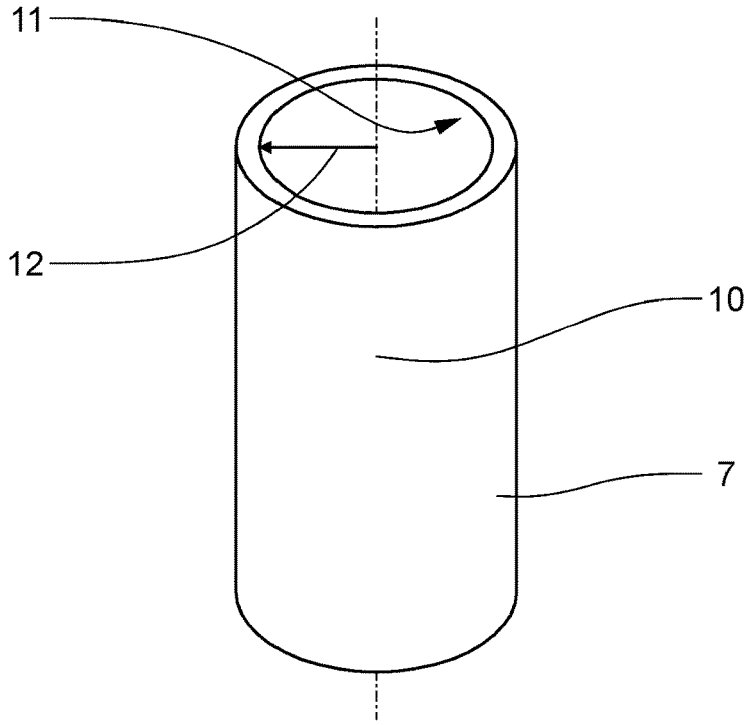
FIG. 2 illustrates an abstracted perspective view of a cylinder of the first embodiment.
Figure 3:
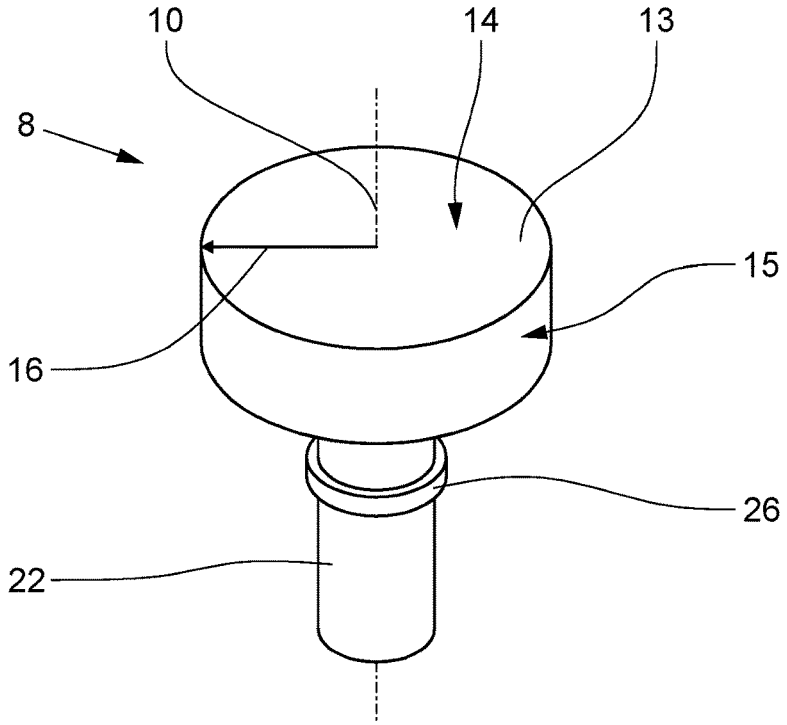
FIG. 3 illustrates an abstracted perspective view of a reciprocating piston of the first embodiment
Figure 4A:
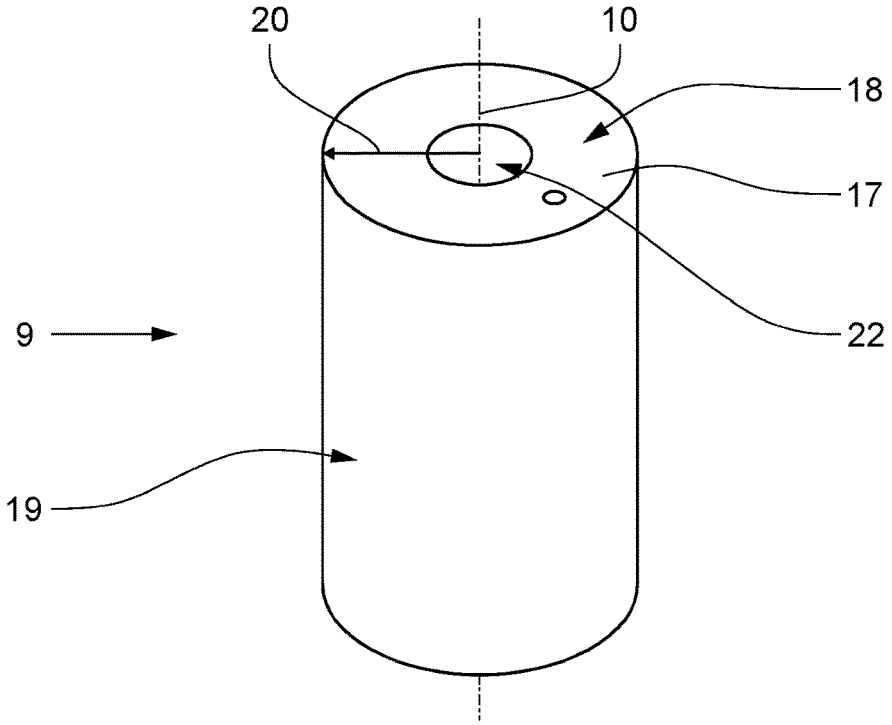
FIGS. 4*a* and 4*b* illustrate two different abstracted perspective views of an auxiliary reciprocating piston of the first embodiment.
Figure 4B:
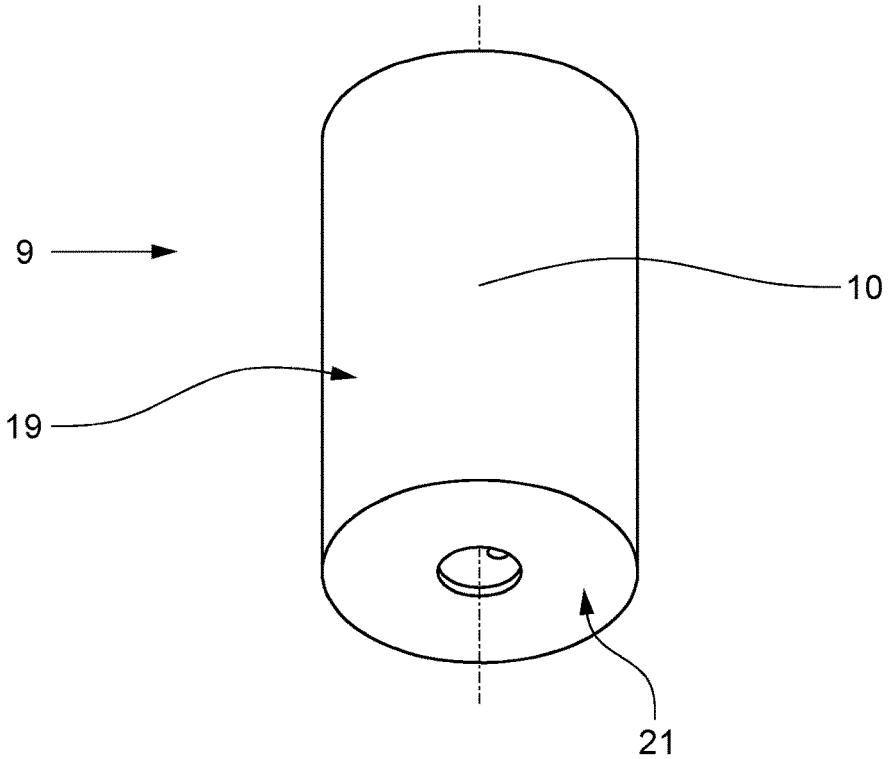

The pump module 2 has a cylinder head 6, a cylinder 7, see also FIG. 2, a reciprocating piston 8, see also FIG. 3, and an auxiliary reciprocating piston 9, see also FIGS. 4*a*, 4*b*.

The cylinder 7 has a cylinder inner lateral surface 11 concentric to a longitudinal axis 10 with a cylinder radius 12. The reciprocating piston 8 has a reciprocating piston bottom 13 with a reciprocating piston head surface 14 and a reciprocating piston outer lateral surface 15 concentric to the longitudinal axis 10 with a reciprocating piston radius 16. The auxiliary reciprocating piston 9 is disposed between the drive 3 and the reciprocating piston 8, has an auxiliary reciprocating piston head surface 17 with an auxiliary reciprocating piston head surface 18, an auxiliary reciprocating piston outer surface 19 concentric with the longitudinal axis with an auxiliary reciprocating piston radius 20, and an auxiliary reciprocating piston sliding surface 21. The reciprocating piston radius 16 and the auxiliary reciprocating piston radius 20 are the same and match the cylinder radius 12.

The reciprocating piston 8 has a relief reciprocating piston 22, and the auxiliary reciprocating piston 9 has a relief cylinder 23 in the auxiliary reciprocating piston head 17 to match the relief reciprocating piston 22. The relief cylinder 23 is connected to the surroundings as a relief chamber via a relief line 24. In this embodiment, the relief reciprocating piston 22 is is a shaft.

The relief stroke piston 22 and the relief cylinder 23 limit a piston distance between the reciprocating piston 8 and the auxiliary reciprocating pistons 9 along the longitudinal axis 10 to a maximum piston distance. For this purpose, the relief reciprocating piston 22 has a ring 26 and the relief cylinder 23 has a groove 27 matching the ring 26. The reciprocating piston 8 and the auxiliary reciprocating piston 9 are movable relative to each other along the longitudinal axis 10 in correspondence with the ring 26 and the groove 7.

The drive 3 has a drive shaft 28 and the drive shaft 28 has a drive eccentric 29 with an eccentric sliding surface 30. The drive shaft 28 without a drive eccentric 29 is designed as a crankshaft with a crank pin 31, wherein the crank pin 31 is rotatably arranged in the drive eccentric 29. Rotational movement of the drive eccentric 29 is prevented by an eccentric shape of the eccentric sliding surface 30 in conjunction with the overlying auxiliary reciprocating piston sliding surface 21.

The eccentric sliding surface 30 and the auxiliary reciprocating piston sliding surface 21 form the bearing 4. The bearing 4 is arranged between the drive 3 and the auxiliary reciprocating piston 9. The drive shaft 28 with the drive eccentric 29 and the auxiliary reciprocating piston 9 are designed for converting a drive movement 32 of the drive shaft 28 in the form of a rotation via the bearing 4 into an auxiliary conveying stroke movement 33 and into an auxiliary suctioning stroke movement 34 of the auxiliary reciprocating piston 9 in the cylinder 7 along the longitudinal axis 10. Thus, the bearing 4 is designed for converting the driving movement 32 into the auxiliary conveying stroke movement 33 and into the auxiliary suctioning stroke movement 34.

The cylinder head 6, the cylinder 7 and the reciprocating piston head 9 form a conveying chamber 35. Further, the cylinder 7, the reciprocating piston 8 and the auxiliary reciprocating piston head 17 form a lubrication chamber 36 for a lubricating medium for lubricating contact surfaces between, on the one hand, the cylinder 7 and, on the other hand, the reciprocating piston 8 and the auxiliary reciprocating piston 9. In this embodiment, the contact surfaces are, on the one hand, the cylinder inner lateral surface 11 and the reciprocating piston outer lateral surface 15 and, on the other hand, the cylinder inner lateral surface 11 and the auxiliary reciprocating piston outer lateral surface 19.

The cylinder 7, the reciprocating piston 8 and the auxiliary reciprocating piston 9 are designed for converting the driving movement 32 into the auxiliary conveying stroke movement 33 and the auxiliary suctioning stroke movement 34 of the auxiliary reciprocating piston 9 in the cylinder 7 along the longitudinal axis 10, and also for converting the auxiliary conveying stroke movement 33 of the auxiliary reciprocating piston 9 into a conveying stroke movement 37 of the reciprocating piston 8 in the cylinder 7 along the longitudinal axis 10 via a lubrication chamber 36. In the present embodiment, the cylinder 7, the reciprocating piston 8 and the auxiliary reciprocating piston 9 are further designed for converting the auxiliary suctioning stroke movement 34 of the auxiliary reciprocating piston 9 into a suctioning stroke movement 3 of the reciprocating piston 8 in the cylinder 7 along the longitudinal axis 10 via a lubrication chamber 36.

In this respect, the reciprocating piston 8 is designed for converting the drive movement 32 of the drive 3 into the conveying stroke movement 37 and into the suctioning stroke movement 38 of the reciprocating piston 8 in the cylinder 7 along the longitudinal axis 10.

The cylinder head 6, the cylinder 7 and the reciprocating piston 8 are designed for converting the conveying stroke movement 37 of the reciprocating piston 8 into a conveyance of a medium from the conveying chamber 35 by making the conveying chamber 35 smaller. For this, the cylinder head 6 has a cylinder head controller which ensures an inflow of a medium into the conveying chamber 35 during the suctioning stroke movement 38 and an outflow of a medium from the conveying chamber 35 during the conveying stroke movement 37. For this purpose, the cylinder head controller comprises an inflow valve and an outflow valve. Neither the cylinder head controller nor the inflow valve and the outflow valve are shown. In this embodiment, the cylinder head 6, the cylinder 7, and the reciprocating piston 8 are also designed for converting the suctioning stroke movement 38 into a suctioning of a medium into the conveying chamber 35 by increasing the conveying chamber 35.

The auxiliary reciprocating piston head surface 18 is smaller than the reciprocating piston head surface 14 because the auxiliary reciprocating piston head surface 18, unlike the reciprocating piston head surface 14, lacks a cross-sectional area of the relief cylinder 23. As a result, during the auxiliary conveying stroke movement 33 of the auxiliary reciprocating piston 9, a pressure of a lubricant in the lubricating chamber 36 is greater than a pressure of a medium in the conveying chamber 35 resulting from the conveying stroke movement 37 of the reciprocating piston 8.

The auxiliary reciprocating piston 9 has an auxiliary reciprocating piston lubrication line 39. The auxiliary reciprocating piston lubrication line 39 connects the lubrication chamber 36 and the auxiliary reciprocating piston sliding surface 21 to each other for supplying the bearing 4 with a lubricating medium. The auxiliary reciprocating piston lubrication line 39 is a channel in the auxiliary reciprocating piston 9. Preferably, the drive eccentric 29 has an auxiliary lubrication line connecting the eccentric sliding surface 30 to contact surfaces between the crank pin 31 and the drive eccentric 29 so that these contact surfaces are also supplied with a lubricating medium during operation. However, this auxiliary lubrication line is not shown here.

The reciprocating pump 1 further comprises a longitudinal slide valve 40 for controlling the supply of a lubrication medium into the lubrication chamber 36. The longitudinal slide valve 40 has a cylinder opening 41 in the cylinder 7 for feeding a lubrication medium into the lubrication chamber 36. The cylinder opening 41 is a bore. The cylinder opening releases the supply of a lubrication medium into the lubrication chamber 36 when the reciprocating piston 8 is in the region of a reversal point from the suctioning stroke movement 38 to the conveying stroke movement 37.

The lubrication pump 5 is designed for supplying a lubrication medium to the pump module 2 and the actuator 3, and the reciprocating piston pump 1 is designed for supplying a lubrication medium from the lubrication pump to the longitudinal slide valve 40. During operation of the reciprocating piston pump 1, the auxiliary reciprocating piston lubrication line 39 not only supplies the contact surfaces between, on the one hand, the cylinder 7 and, on the other hand, the reciprocating piston 8 and the auxiliary reciprocating piston 9, but also supplies the bearing 4 with a lubricating medium for lubrication. The bearing 4 is supplied from the lubrication chamber 36 via the auxiliary reciprocating piston lubrication line 39.

Figure 5:
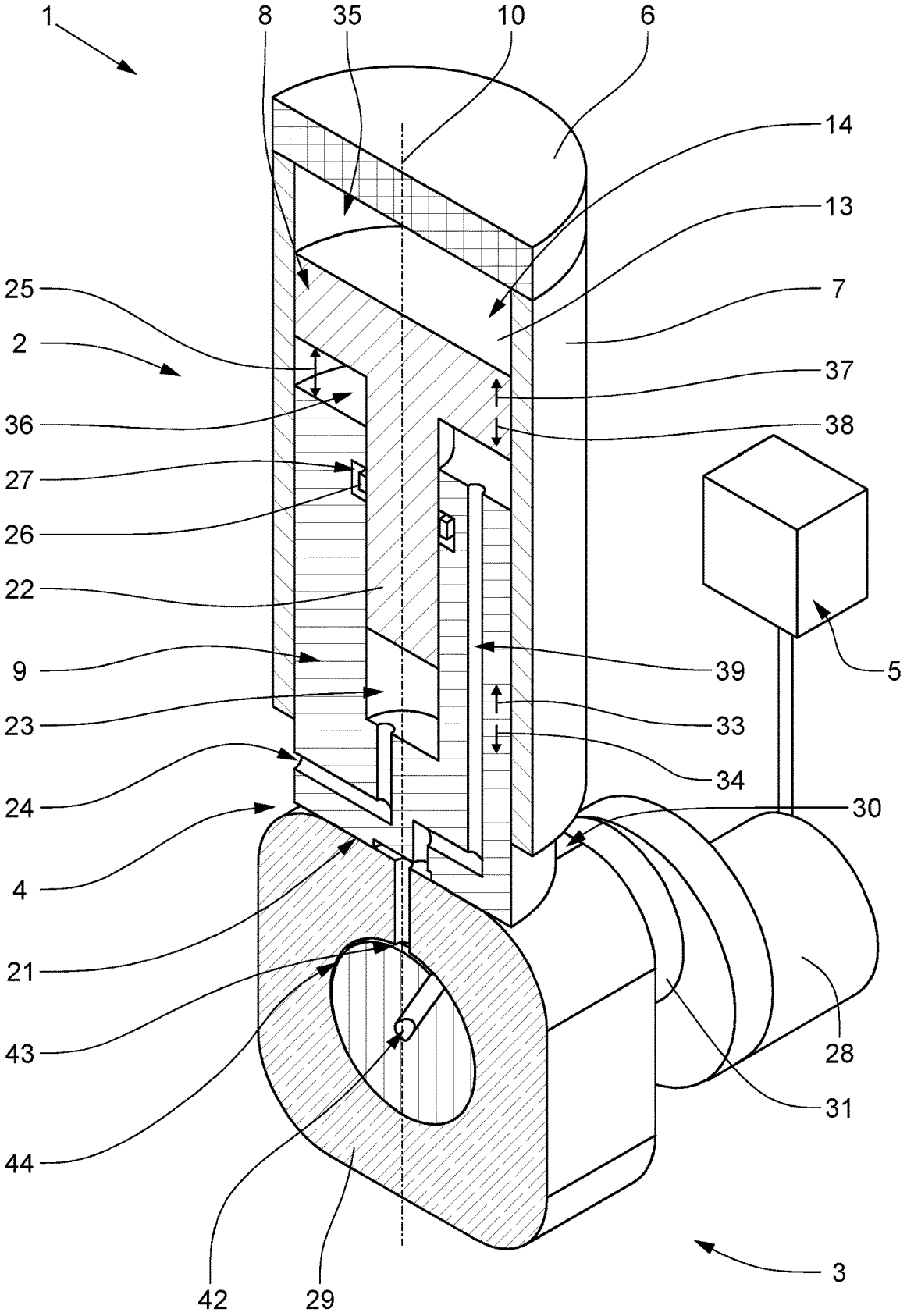
FIG. 5 illustrates an abstracted perspective sectional view of a second embodiment of a reciprocating pump.

FIG. 5 shows a second embodiment of a reciprocating piston pump 1 for supplying a medium. In the following, only the differences to the first embodiment are described. Otherwise, the explanations regarding the first apply analogously to the second embodiment.

In contrast to the first embodiment, the reciprocating pump 1 does not have the described longitudinal slide valve 40 in the second embodiment. Instead, the drive shaft 28 has a drive lubrication line 42. Accordingly, the drive lubrication line 42 extends through the drive shaft 28 itself as well as through the drive eccentric 29. The part of the drive lubrication line 42 in the drive eccentric 29 thus corresponds to that of the auxiliary lubrication line in the first embodiment.

Further, the drive shaft 28 has a rotary slide valve 43 for controlling the supply of a lubricating medium into the bearing 4. The rotary slide valve 43 has a drive shaft recess 44 in the drive shaft 28 over an angular range of a rotation of the drive shaft 28, whereby a supply of a lubricating medium into the bearing 4 occurs only over the angular range. In this embodiment, the drive lubrication line 42 is a channel in the drive shaft 28 and in the drive eccentric 29. The rotary slide valve 43 is formed by the drive shaft recess 44 and the drive lubrication line 42 in the eccentric 29. The rotary slide valve 43 also ensures a supply of lubricant to contact surfaces between the drive shaft 28 and the drive eccentric 29.

The lubrication pump 5 is designed for supplying a lubricant to the pump module 2 and the drive 3, and the reciprocating pump 1 is designed for supplying a lubricant from the lubrication pump 5 to the drive lubrication line 42. Through the drive lubrication line 42 and the auxiliary reciprocating piston lubrication line 39, not only the bearing 4 but also the contact surfaces between on the one hand the cylinder 7 and on the other hand the reciprocating piston 8 and the auxiliary reciprocating piston 9 are supplied with a lubricating medium for lubrication during operation of the reciprocating pump 1. The supply of the contact surfaces between, on the one hand, the cylinder 7 and, on the other hand, the reciprocating piston 8 and the auxiliary reciprocating piston 9, and also the supply of the lubrication chamber 36 with a lubrication medium, take place in this case via the auxiliary reciprocating piston lubrication line 39 and via the bearing 4 from the drive lubrication line 42.

Figure 6:
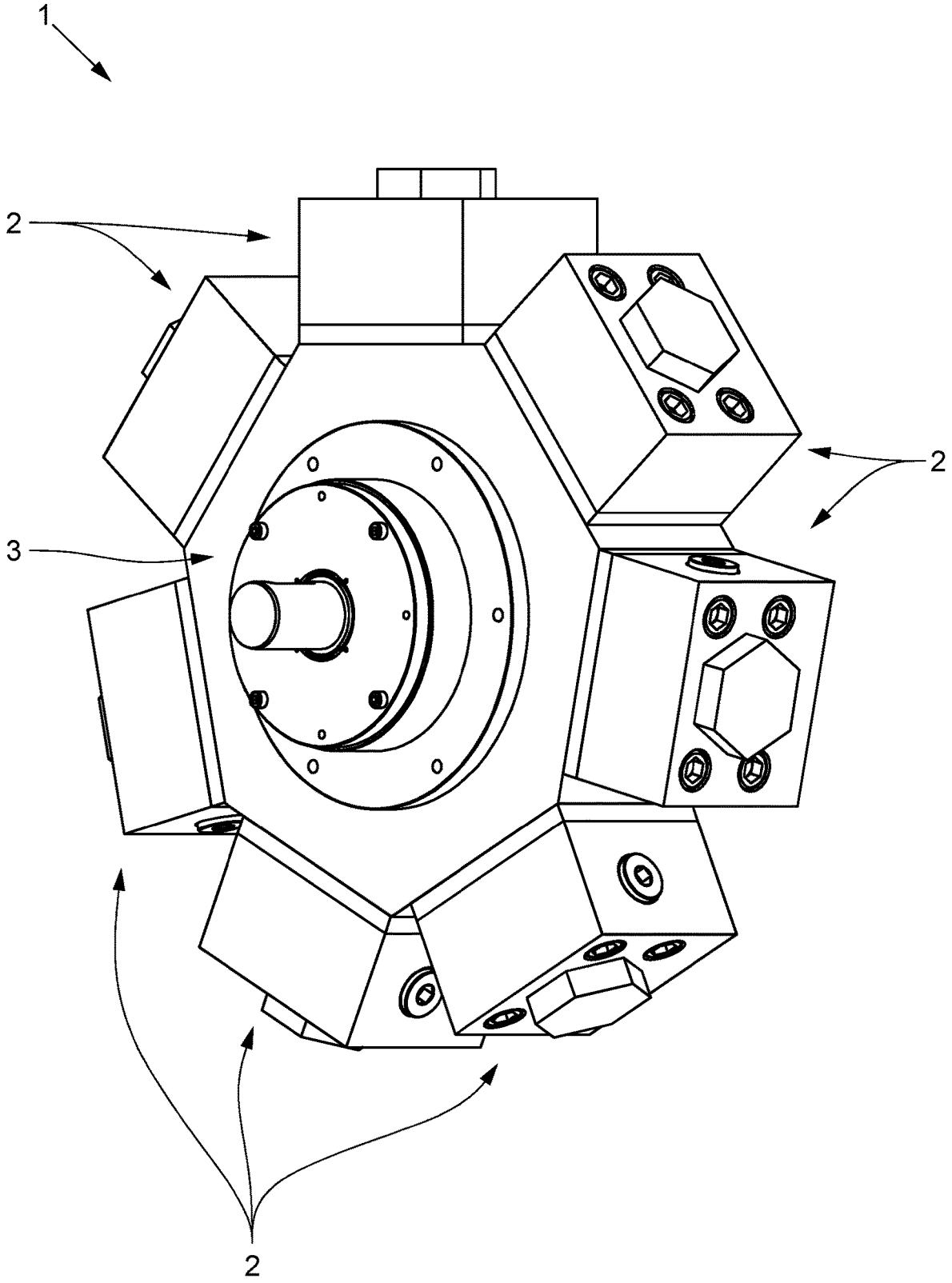
FIG. 6 illustrates a perspective view of a third embodiment of a reciprocating piston pump.

FIG. 6 shows a third embodiment of a reciprocating piston pump 1. In contrast to the first and second embodiments, it has a plurality of pump modules 2. Otherwise, the reciprocating pump 1 is designed like the reciprocating pump described in the first or second embodiment.

The invention claimed is:

1. A reciprocating piston pump for conveying a medium, comprising:

at least one pump module;

a drive; and an auxiliary reciprocating piston;

wherein the at least one pump module includes a cylinder head, a cylinder and a reciprocating piston;

wherein the reciprocating piston has a reciprocating piston head with a reciprocating piston head surface;

wherein the cylinder head, the cylinder and the reciprocating piston head form a conveying chamber;

wherein the reciprocating piston is designed for converting a drive movement of the drive into a conveying stroke movement and into a suctioning stroke movement of the reciprocating piston in the cylinder along a longitudinal axis;

wherein the cylinder head, the cylinder and the reciprocating piston are designed for converting the conveying stroke movement into a conveying of a medium out of the conveying chamber by making the conveying chamber smaller;

wherein the auxiliary reciprocating piston is arranged between the drive and the reciprocating piston and has an auxiliary reciprocating piston head with an auxiliary reciprocating piston head surface;

wherein the cylinder, the reciprocating piston and the auxiliary reciprocating piston head form a lubricating chamber for a lubricating medium for lubricating contact surfaces between the cylinder and the reciprocating piston and contact surfaces between the cylinder and the auxiliary reciprocating piston;

wherein the cylinder, the reciprocating piston and the auxiliary reciprocating piston are designed for converting the drive movement into an auxiliary conveying stroke movement and into an auxiliary suctioning stroke movement of the auxiliary reciprocating piston in the cylinder along the longitudinal axis and for converting the auxiliary conveying stroke movement of the auxiliary reciprocating piston into the conveying stroke movement of the reciprocating piston via the lubricating medium in the lubricating chamber; and wherein the auxiliary reciprocating piston head surface is smaller than the reciprocating piston head surface, so that, during the auxiliary conveying stroke movement, a pressure of the lubricating medium in the lubricating chamber is greater than a pressure of a medium in the conveying chamber.

2. The reciprocating piston pump according to claim 1, wherein, the cylinder has a cylinder inner lateral surface concentric with the longitudinal axis and having a cylinder radius;

wherein the reciprocating piston has a reciprocating piston outer lateral surface concentric with the longitudinal axis and having a reciprocating piston radius;

wherein the auxiliary reciprocating piston has an auxiliary reciprocating piston outer lateral surface concentric with the longitudinal axis and having an auxiliary reciprocating piston radius; and wherein both the reciprocating piston radius and the auxiliary reciprocating piston radius match the cylinder radius and the reciprocating piston radius and the auxiliary reciprocating piston radius are the same.

3. The reciprocating piston pump according to claim 1, wherein the reciprocating piston has a relief reciprocating piston and the auxiliary reciprocating piston has a relief cylinder in the auxiliary reciprocating piston head matching the relief reciprocating piston;

wherein the relief cylinder has a relief chamber and/or is connected to a relief chamber; and wherein the relief reciprocating piston is a shaft.

4. The reciprocating piston pump according to claim 3, wherein the relief reciprocating piston and the relief cylinder limit a piston distance between the reciprocating piston and the auxiliary reciprocating piston along the longitudinal axis to a maximum piston distance.

5. The reciprocating piston pump according to claim 1, wherein the reciprocating piston pump has a bearing; and wherein the bearing is arranged between the drive and the auxiliary reciprocating piston and is designed for converting the drive movement into the auxiliary conveying stroke movement and into the auxiliary suctioning stroke movement.

6. The reciprocating piston pump according to claim 5, wherein the drive has a drive shaft, wherein the drive shaft has a drive eccentric with an eccentric sliding surface;

wherein the auxiliary reciprocating piston has an auxiliary reciprocating piston sliding surface;

wherein the eccentric sliding surface and the auxiliary reciprocating piston sliding surface form the bearing; and wherein the drive shaft and the auxiliary reciprocating piston are designed for converting the drive movement of the drive shaft in the form of a rotation via the bearing into the auxiliary conveying stroke movement and into the auxiliary suctioning stroke movement.

7. The reciprocating piston pump according to claim 6, wherein the drive shaft has a drive lubrication line and a rotary slide valve for controlling the supply of the lubricating medium into the bearing;

wherein the rotary slide valve has a drive shaft recess in the drive shaft over an angular range of rotation of the drive shaft, so that a supply of the lubricating medium to the bearing takes place only over the angular range; and wherein the drive lubrication line is a channel in the drive shaft and in the drive eccentric.

8. The reciprocating piston pump according to claim 7, wherein the drive lubrication line has at least one check valve.

9. The reciprocating piston pump according to claim 5, wherein the auxiliary reciprocating piston has an auxiliary reciprocating piston lubrication line;

wherein the auxiliary reciprocating piston lubrication line connects the lubrication chamber and the auxiliary reciprocating piston sliding surface for supplying the bearing with the lubricating medium; and wherein the auxiliary reciprocating piston lubrication line is a channel in the auxiliary reciprocating piston.

10. The reciprocating piston pump according to claim 9, wherein the auxiliary reciprocating piston lubrication line has at least one check valve.

11. The reciprocating piston pump according to claim 1, wherein the reciprocating piston pump has a longitudinal slide valve for controlling the supply of the lubricating medium into the lubrication chamber;

wherein the longitudinal slide valve has at least one cylinder opening in the cylinder for supplying the lubricating medium into the lubrication chamber; and wherein the at least one cylinder opening is a groove, pocket and/or bore.

12. The reciprocating piston pump according to claim 11, wherein the at least one cylinder opening releases a supply of the lubricating medium to the lubricating chamber when the reciprocating piston is in the region of a reversal point from the suctioning stroke movement towards the conveying stroke movement.

13. The reciprocating piston pump according to claim 11, wherein the reciprocating piston pump has a lubricating pump for supplying the at least one pump module and/or the drive with the lubricating medium; and wherein the reciprocating piston pump is designed for supplying the lubricating medium from the lubricating pump to the longitudinal slide valve and/or to a drive lubrication line.

14. The reciprocating piston pump according to claim 1, wherein the reciprocating piston has a shaft extending from the reciprocating piston head; and wherein the cylinder, the reciprocating piston head, the shaft, and the auxiliary reciprocating piston head form the lubricating chamber.

15. The reciprocating piston pump according to claim 14, wherein the shaft is a relief reciprocating piston; and wherein the auxiliary reciprocating piston has a relief cylinder in the auxiliary reciprocating piston head matching the relief reciprocating piston.

16. The reciprocating piston pump according to claim 15, wherein the relief cylinder has a relief chamber and/or is connected to a relief chamber.

* * * * *